US005702068A

United States Patent [19]

Stoll et al.

[11] Patent Number: 5,702,068

[45] Date of Patent: Dec. 30, 1997

[54] SEEKER HEAD PARTICULARLY FOR AUTOMATIC TARGET TRACKING

[75] Inventors: Alfred Stoll, Überlingen-Nussdorf; Wolfgang Gulitz, Überlingen; Hans Tessari, Überlingen; Reiner Eckhardt, Überlingen, all of Germany

[73] Assignee: Bodenseewerk Gerätetechnik GmbH, Uberlingen, Germany

[21] Appl. No.: 79,479

[22] Filed: Sep. 25, 1979

[30] Foreign Application Priority Data

Sep. 29, 1978 [DE] Germany ..... 28 41 748.3

[51] Int. Cl.[6] ..... F41G 7/26

[52] U.S. Cl. ..... 244/3.16; 244/3.15

[58] Field of Search ..... 244/3.16, 3.15, 244/3.19

[56] References Cited

U.S. PATENT DOCUMENTS

| | | | |
|---|---|---|---|
| 2,911,167 | 11/1959 | Null et al. | 244/3.16 |
| 2,961,190 | 11/1960 | Miller et al. | 244/3.15 |
| 3,365,148 | 1/1968 | Preston et al. | 244/3.16 |
| 3,494,576 | 2/1970 | Lamelot | 244/3.16 |

FOREIGN PATENT DOCUMENTS

| | | |
|---|---|---|
| 736200 | 9/1955 | United Kingdom . |
| 818494 | 8/1959 | United Kingdom . |
| 900047 | 7/1962 | United Kingdom . |

*Primary Examiner*—Charles T. Jordan

*Attorney, Agent, or Firm*—Keck, Mahin & Cate

[57] ABSTRACT

In a seeker head a field of view is scanned cyclically for providing picture informations referenced to a seeker-fixed coordinate system. The seeker carries a gyro assembly, which provides attitude variation signals as a function of attitude variations of the seeker relative to inertial space. The attitude variation signals are applied to a coordinate transformer which transforms all picture informations with their addresses into an inertial coordinate system which coincided with the seeker-fixed coordinate system after the completion of the preceding scan. Thereby during each scan all picture informations are transformed into one single inertial coordinate system. After the completion of the scan, the picture informations are again transformed into an inertial coordinate system, which coincided with the seeker-fixed coordinate system at the end of said scan, and are stored in a memory. This is the same coordinate system into which the picture informations will be transformed during the next-following scan. Thus at the end of this next-following scan the picture informations from two consecutive scans are available, which are referenced to one single, common coordinate system and are therefore comparable in spite of attitude variations of the seeker. These picture informations are applied to signal processing means, such as a target selection logic.

8 Claims, 15 Drawing Sheets

SEEKER HEAD PARTICULARLY FOR AUTOMATIC TARGET TRACKING

The invention relates to a seeker head comprising field of view scanning means for cyclically scanning the field of view and for providing picture informations referenced to a seeker head-fixed coordinate system, and signal processing means for joint processing of the picture informations from at least two consecutive scans.

This might be a seeker head wherein a rectangular or square visual field is scanned in multiple lines by means of a linear array detector, i.e. a linear array of photoelectric detectors, and an oscillating mirror. Subdividing the scanning movement of the oscillating mirror into angular steps results in a raster of the field of view, in which each picture element (called pixel="picture element" hereinbelow) has "coordinates" associated therewith, namely the line and column numbers of the respective pixel. The seeker head provides picture informations referenced to this seeker head-fixed coordinate system in such a manner that certain pixels are recognized as "bright" and other pixels are recognized as "dark".

It is the function of the seeker head to detect targets, which might be only faintly "perceptible", out of white noise, and to select one target out of the recognized targets in accordance with predetermined criteria. One of the criteria may be the movement of the target within the field of view.

To distinguish a target in the field of view from white noise, it is known to select a threshold value. If the signal from a pixel exceeds this threshold value, it will be observed whether with a predetermined number n ($\geqq 2$) of scans the threshold value will be exceeded at least m times ($m \leqq n$) within the window.

To select a target in accordance with its movement in the field of view. for example in order to discriminate between a tracked aircraft and a mock-target (flare) launched thereby, the displacement of the picture element corresponding to the target in the field of view with consecutive scans has to be detected.

With such and similar applications the picture informations from at least two consecutive scans are processed together. For example the evaluation of a signal exceeding the threshold as a target pulse depends on whether with two consecutive scans such a signal will appear both times within a pixel. The movement of the target can only be derived from the relative positions of the picture informations which are obtained during two or more consecutive scans. A prerequisite of the joint evaluation is, however, that the picture informations to be evaluated are referenced to a common coordinate system, which is not additionally affected by the movements of the carrier, for example of a missile carrying the seeker head. This function cannot be complied with by the seeker head-fixed coordinate system without additional measures. Due to pitch, yaw or roll movements of the carrier even a stationary target may be represented by completely different pixels during consecutive scans.

Therefore it is the object of the invention to make the picture informations from consecutive scans, with a seeker head of the type defined in the beginning, jointly processable in spite of the movement of the seeker head itself.

According to the invention this object is achieved in that a gyro assembly is provided in the seeker head and provides attitude variation signals as a function of attitude variations of the seeker head relative to inertial space, and that the signal processing means comprise a coordinate transformer circuit, to which the attitude variation signals are applied and which are adapted to transform the image informations from the various scans into a common inertial coordinate system.

Further modifications of the invention are subject matter of the sub-claims.

An embodiment of the invention is described hereinbelow with reference to the accompanying drawings.

FIGS. 5*a* to *g* illustrate in the form of block diagrams in different phases the basic principle of the field of view correction and target selection according to the invention.

Figure 5A:
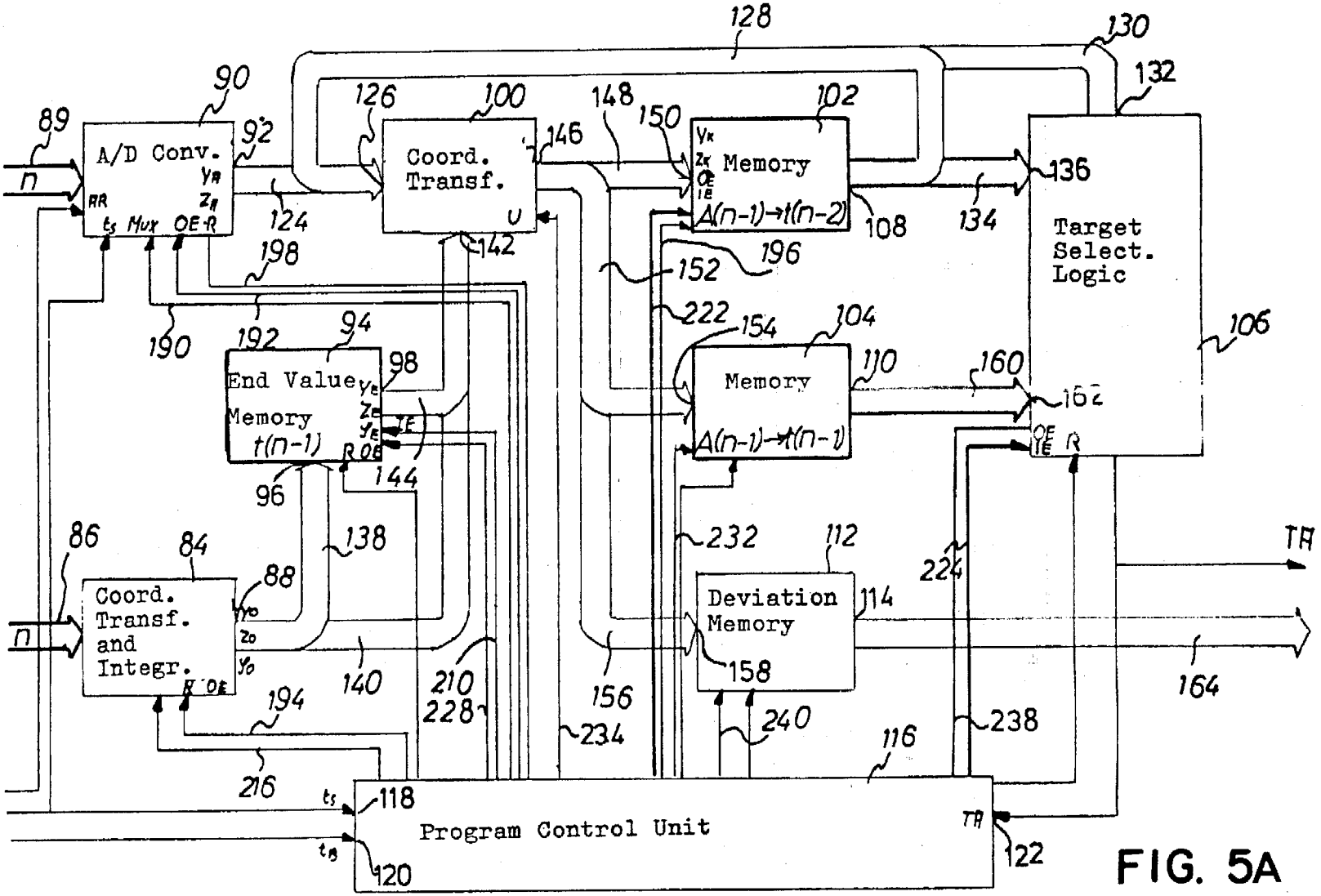
Figure 5B:
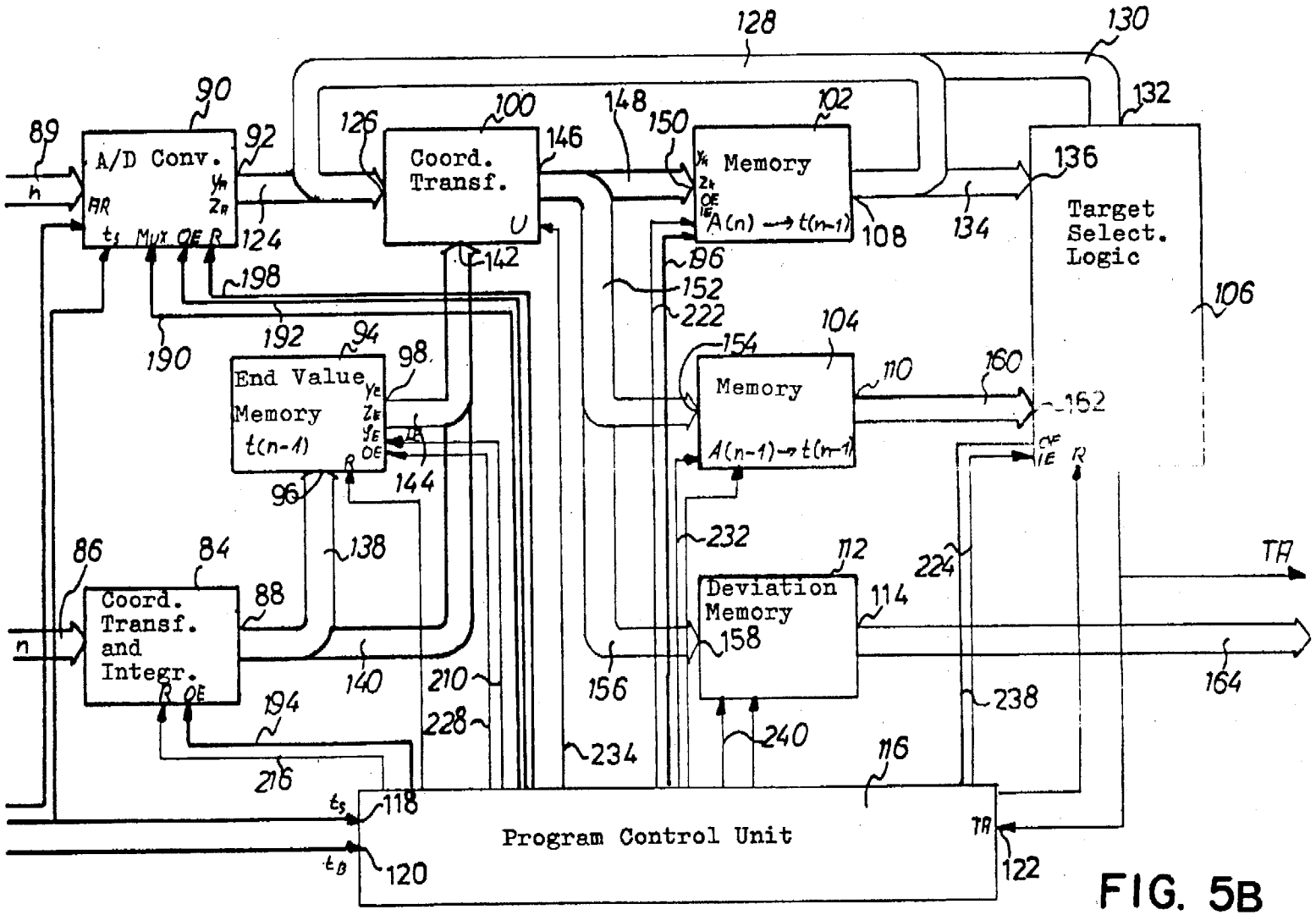
Figure 5C:
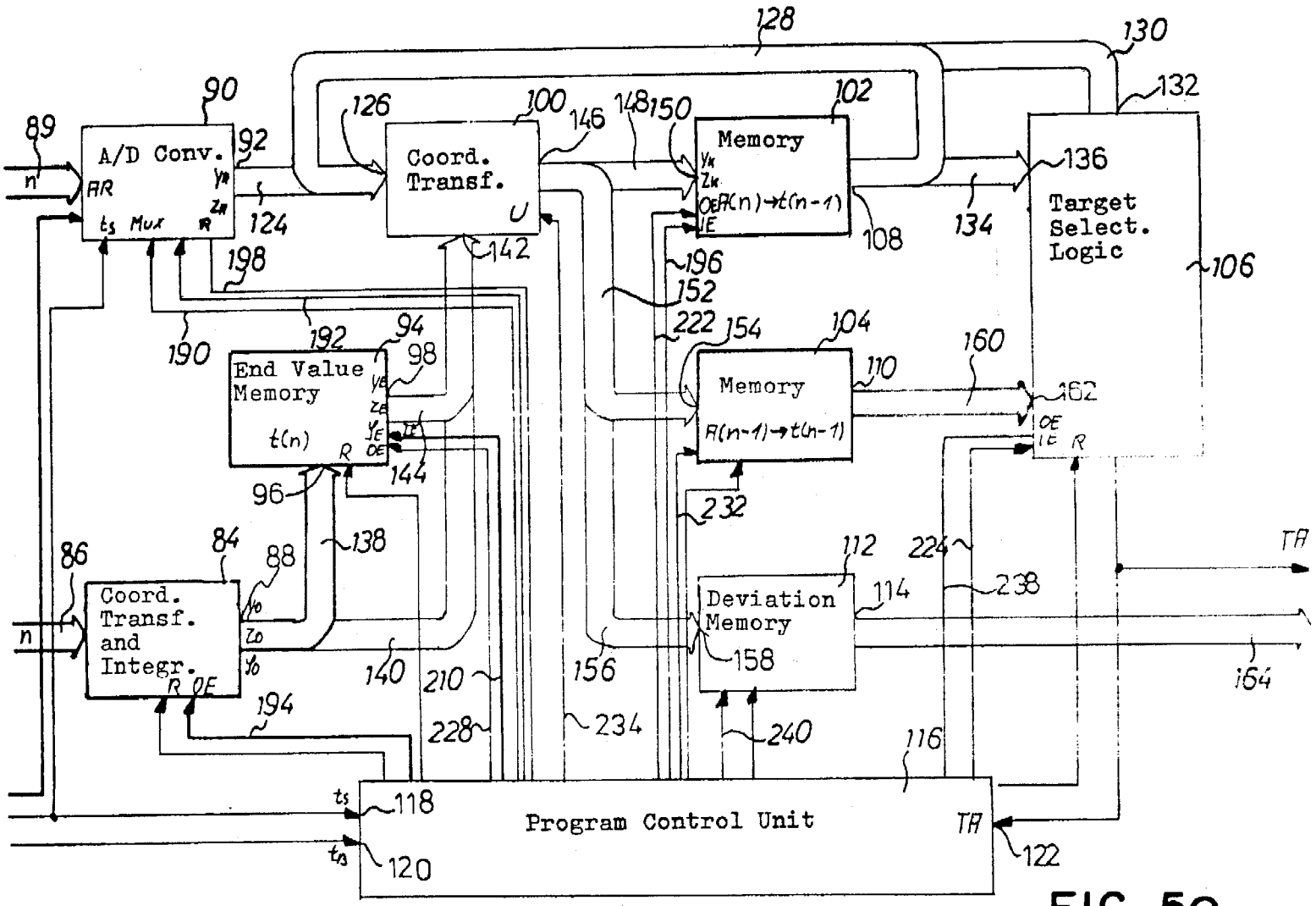
Figure 5D:
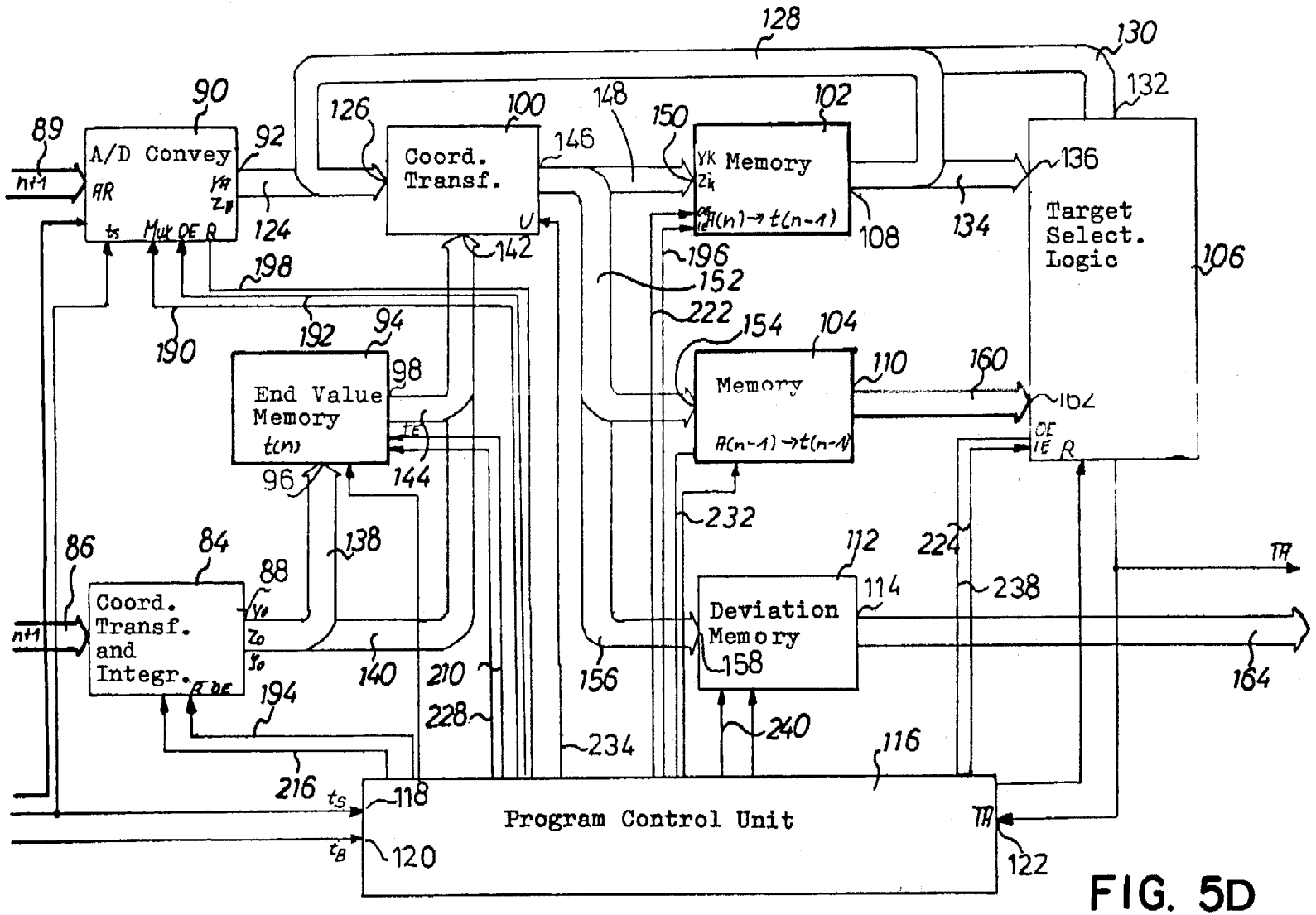
Figure 5E:
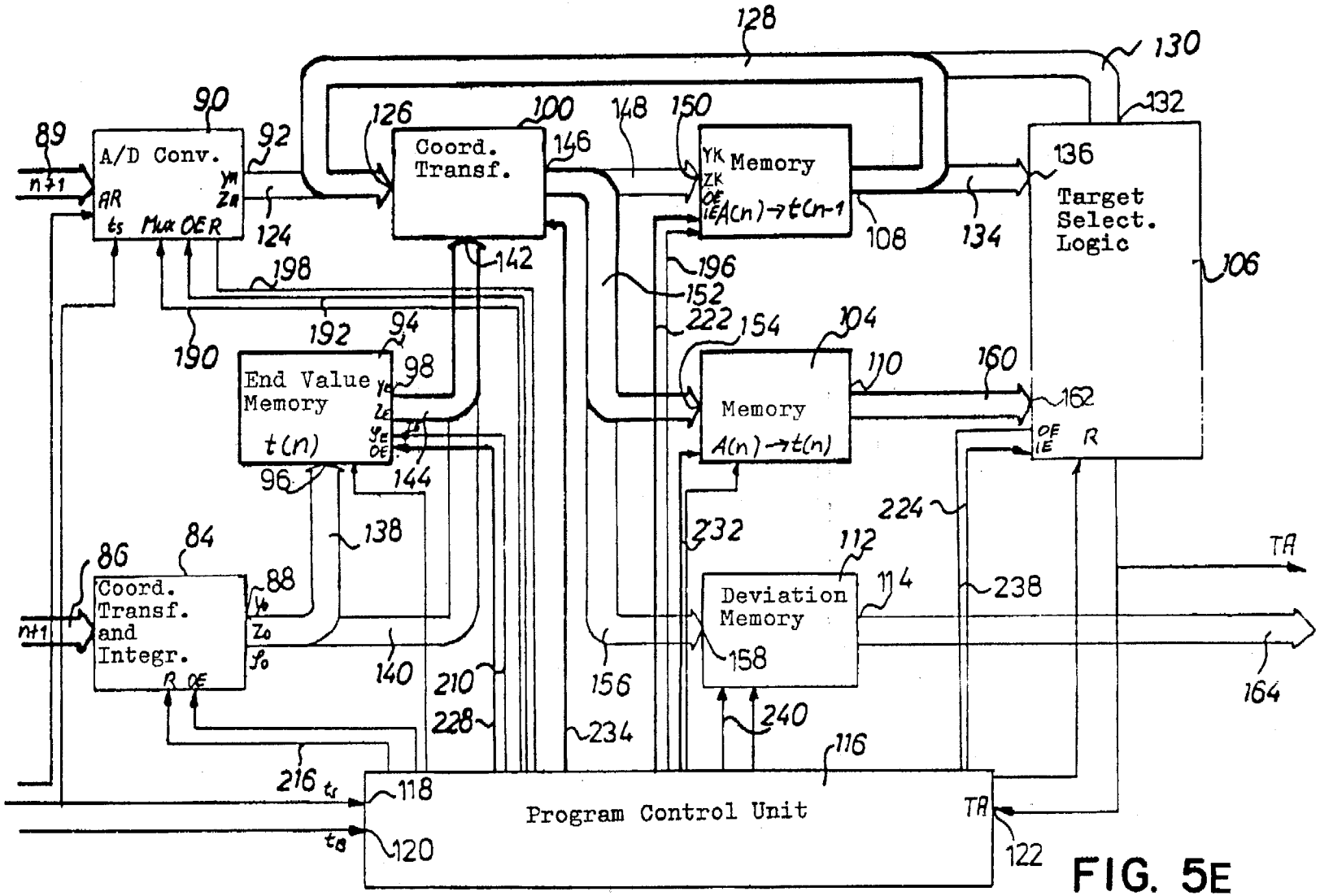
Figure 5F:
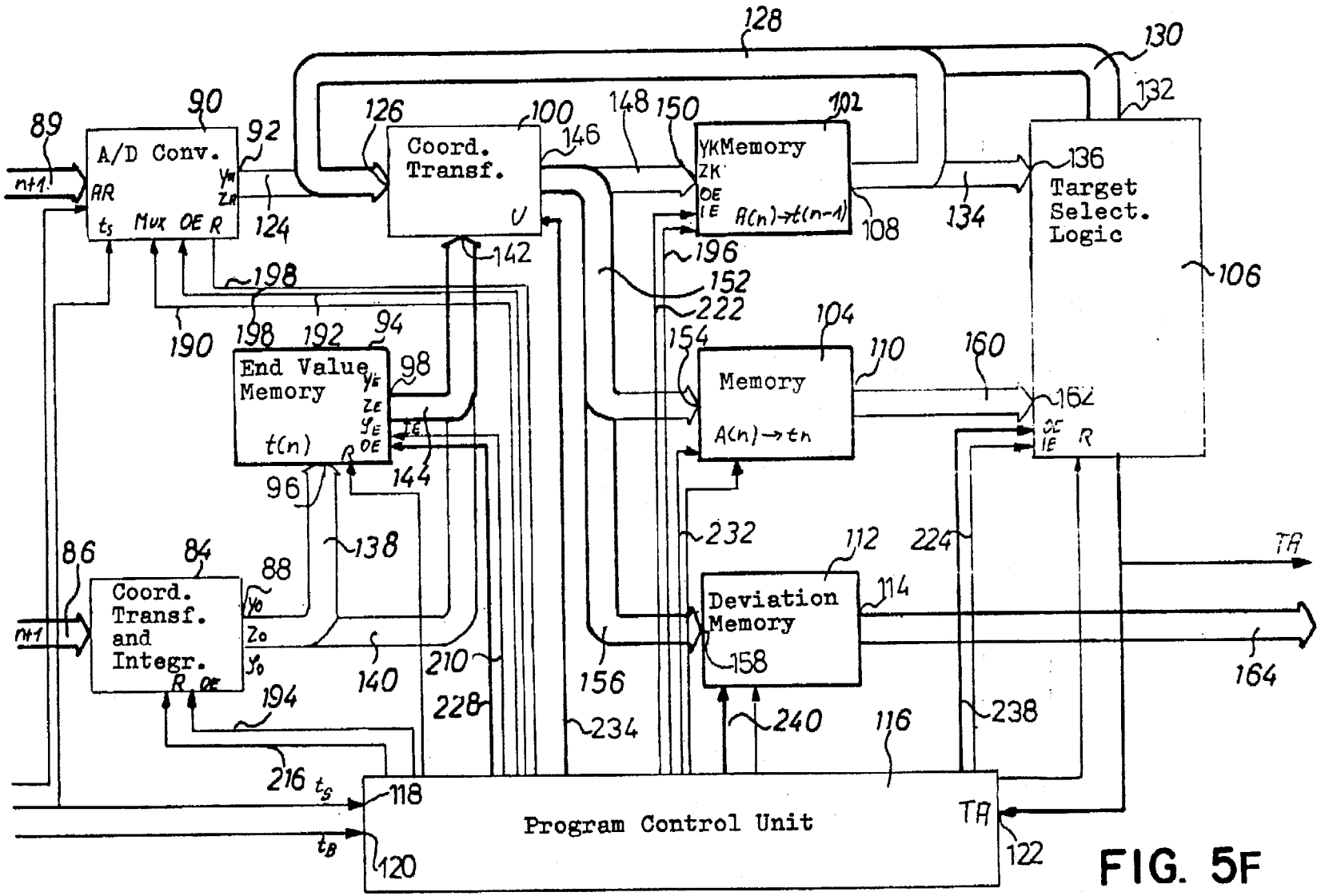
Figure 5G:
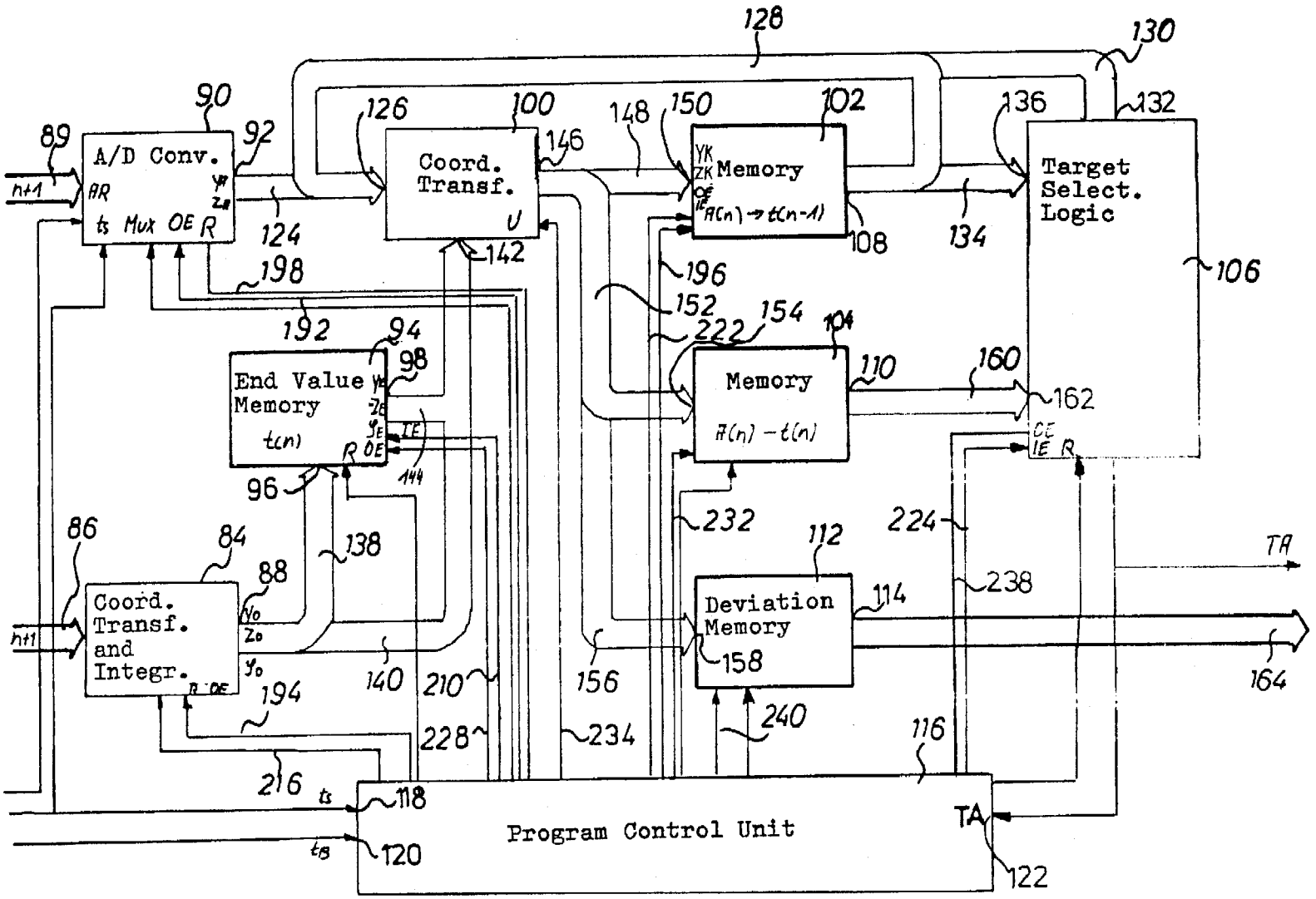
Figure 6:
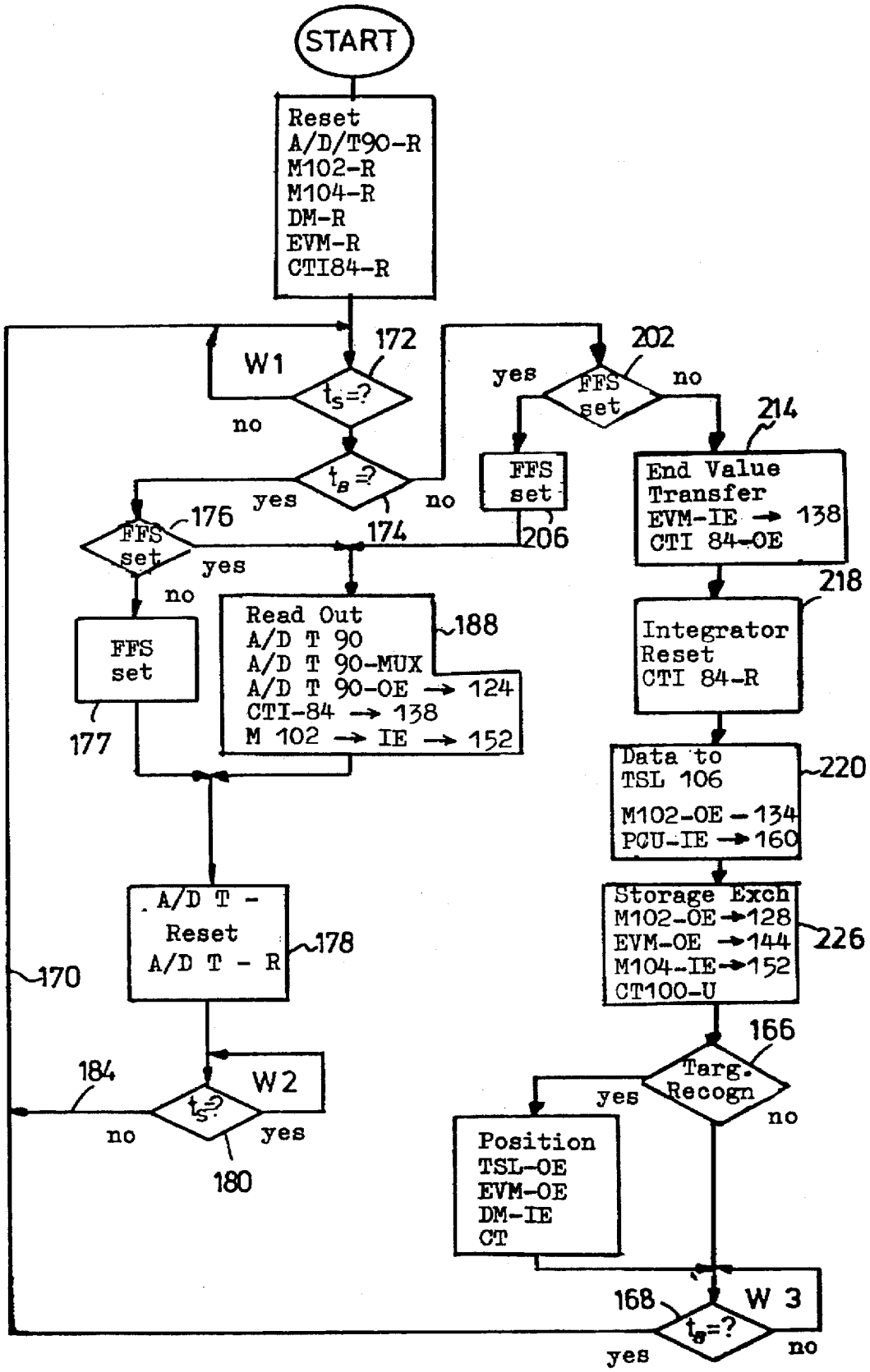

FIG. 6 shows an associated flux diagram which illustrates the operation of the program control unit in FIGS. 5*a* to *g*.

Figure 7:
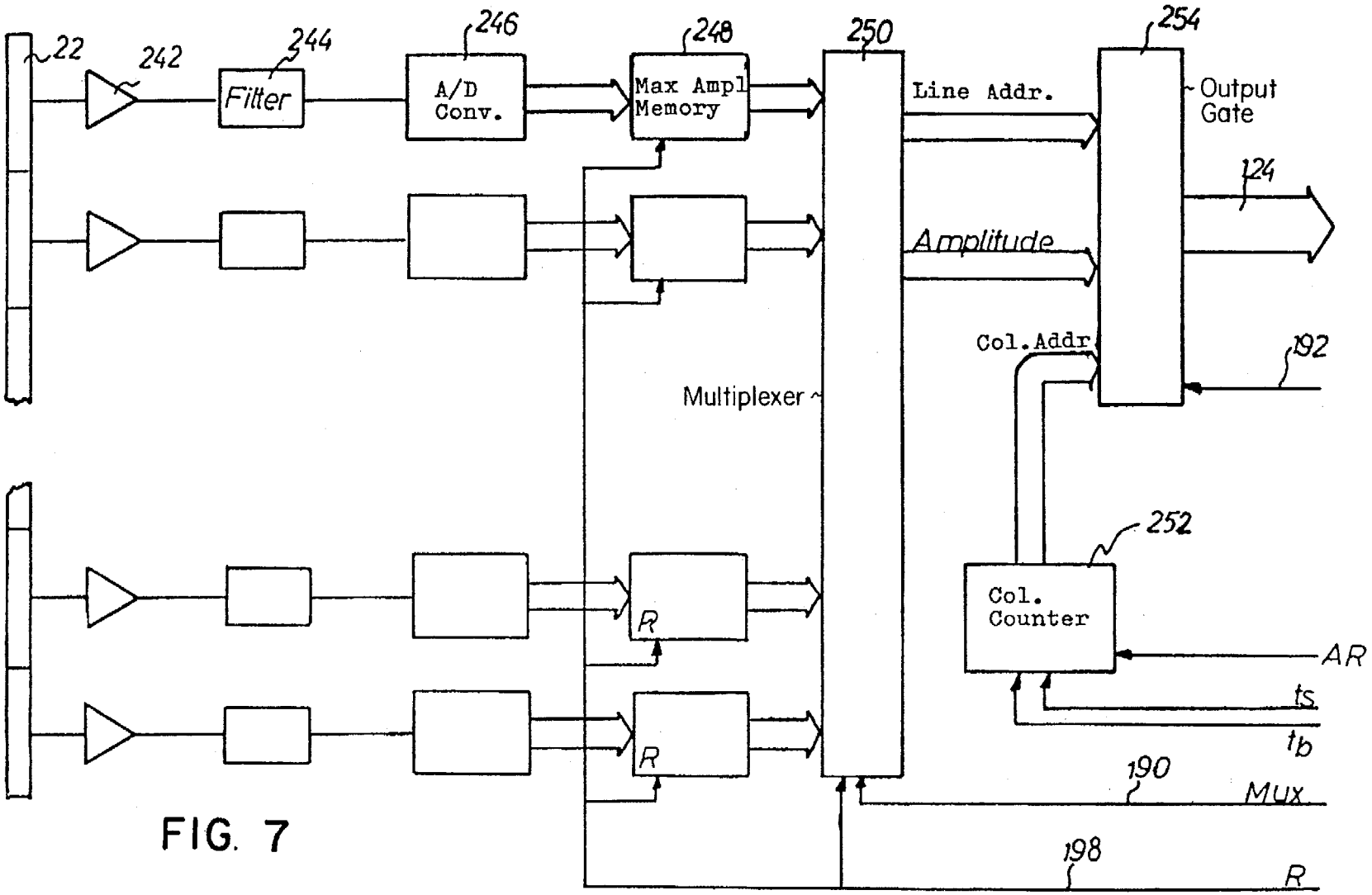

FIG. 7 illustrates in detail the analog-to-digital converter for converting the detector signals into digital picture informations.

Figure 8:
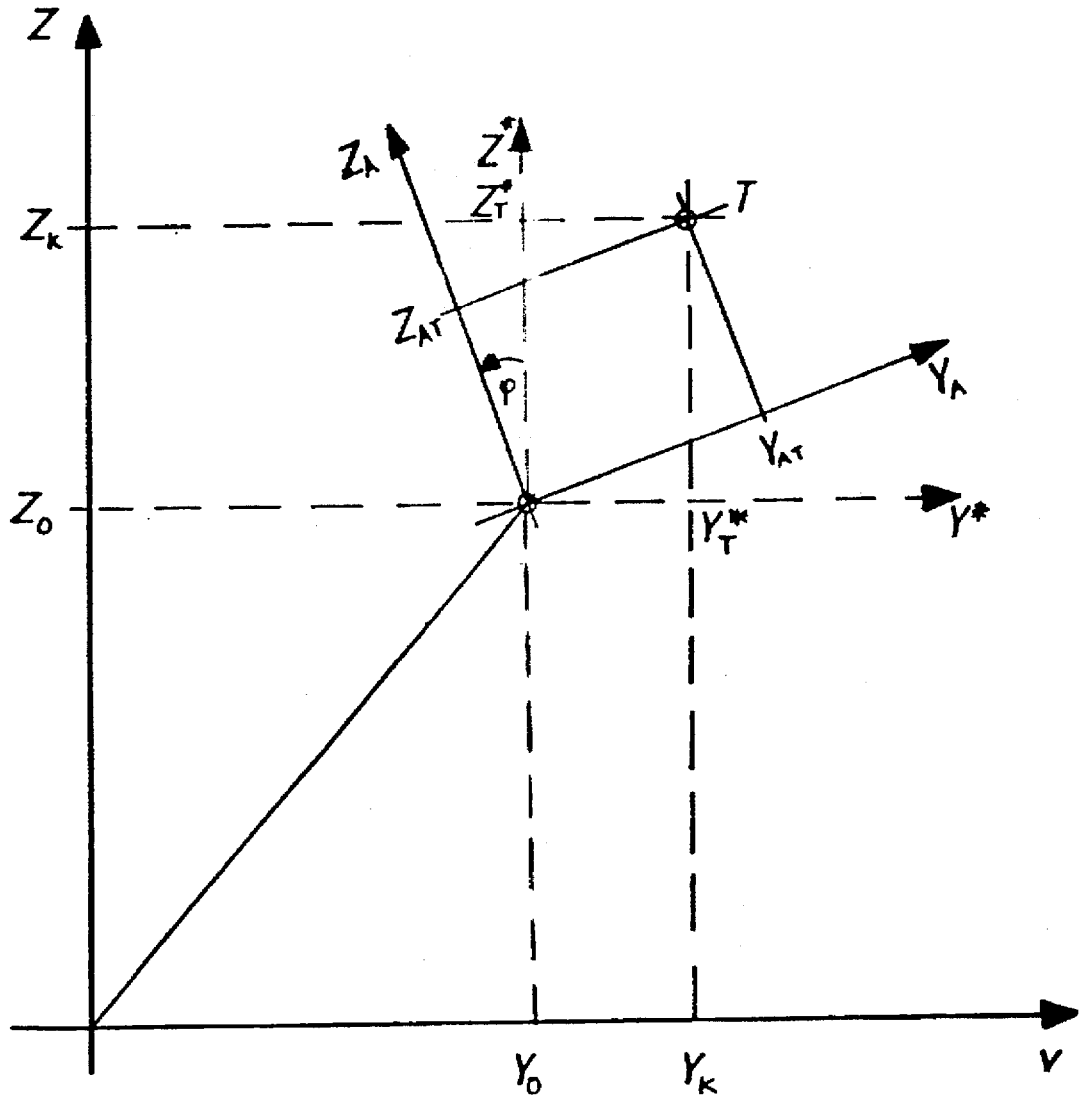

FIG. 8 illustrates the corrections which have to be applied to the coordinates with displacement and rotation of the field of view.

Figure 9:
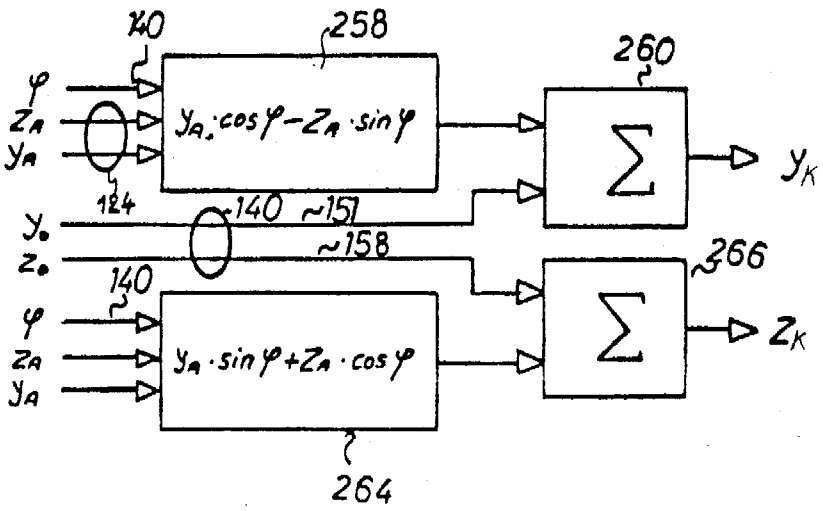

FIG. 9 shows as block diagram the correction logic for the transformation of the picture element coordinates.

Figure 10:
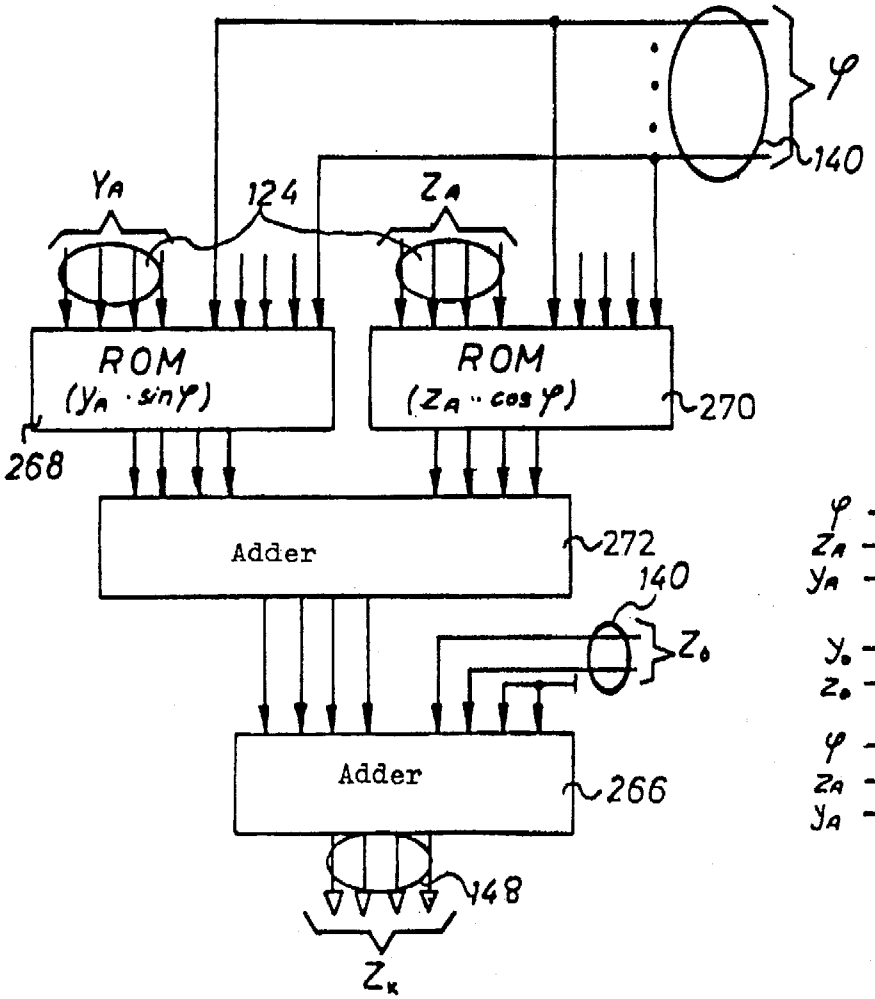

FIG. 10 shows details of the correction logic of FIG. 9.

Figure 11:
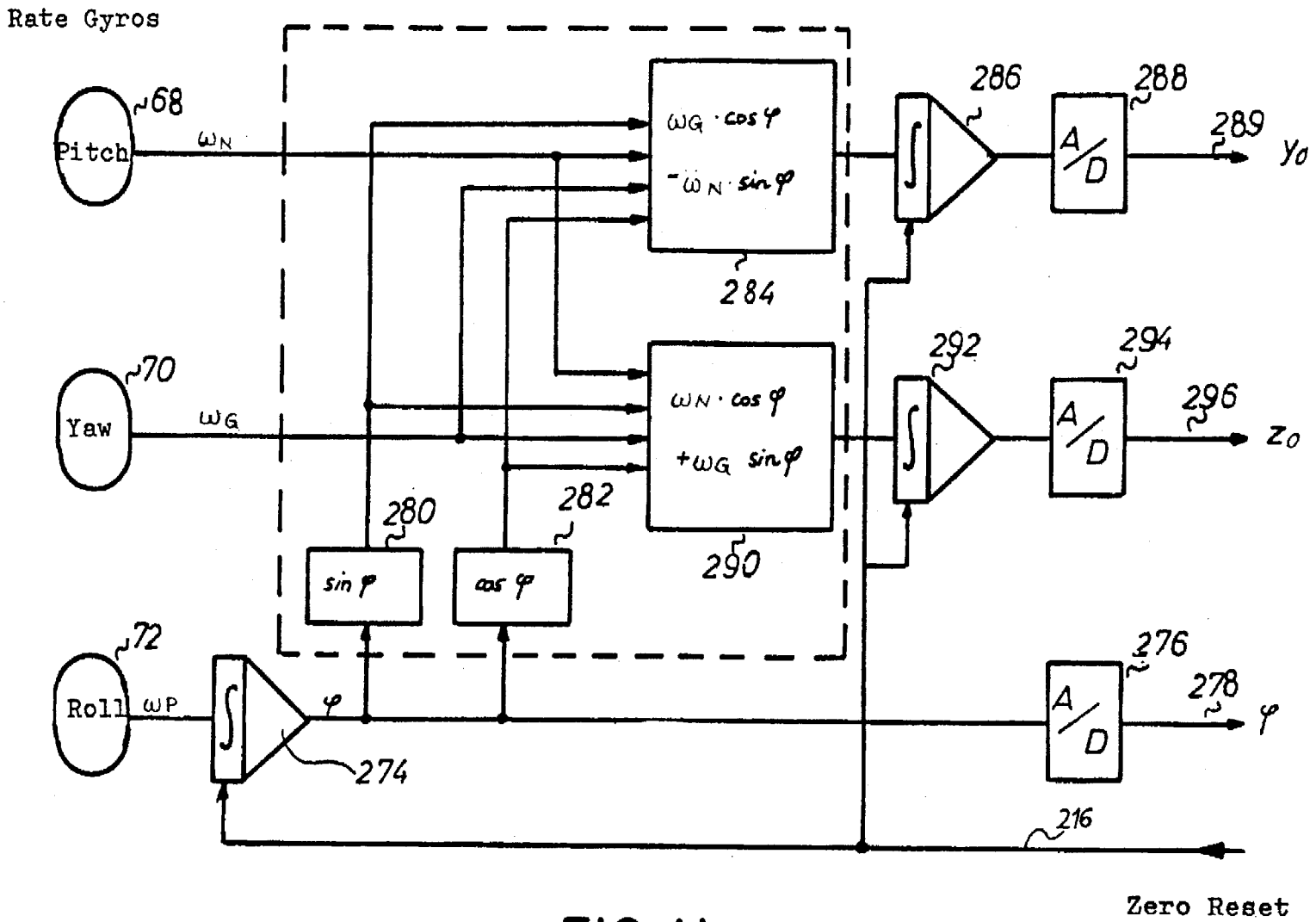

FIG. 11 shows schematically an analog coordinate transformer and integrator circuit for the generation of signals which represent the position variations of the seeker head-fixed coordinate system in inertial space.

Figure 12:
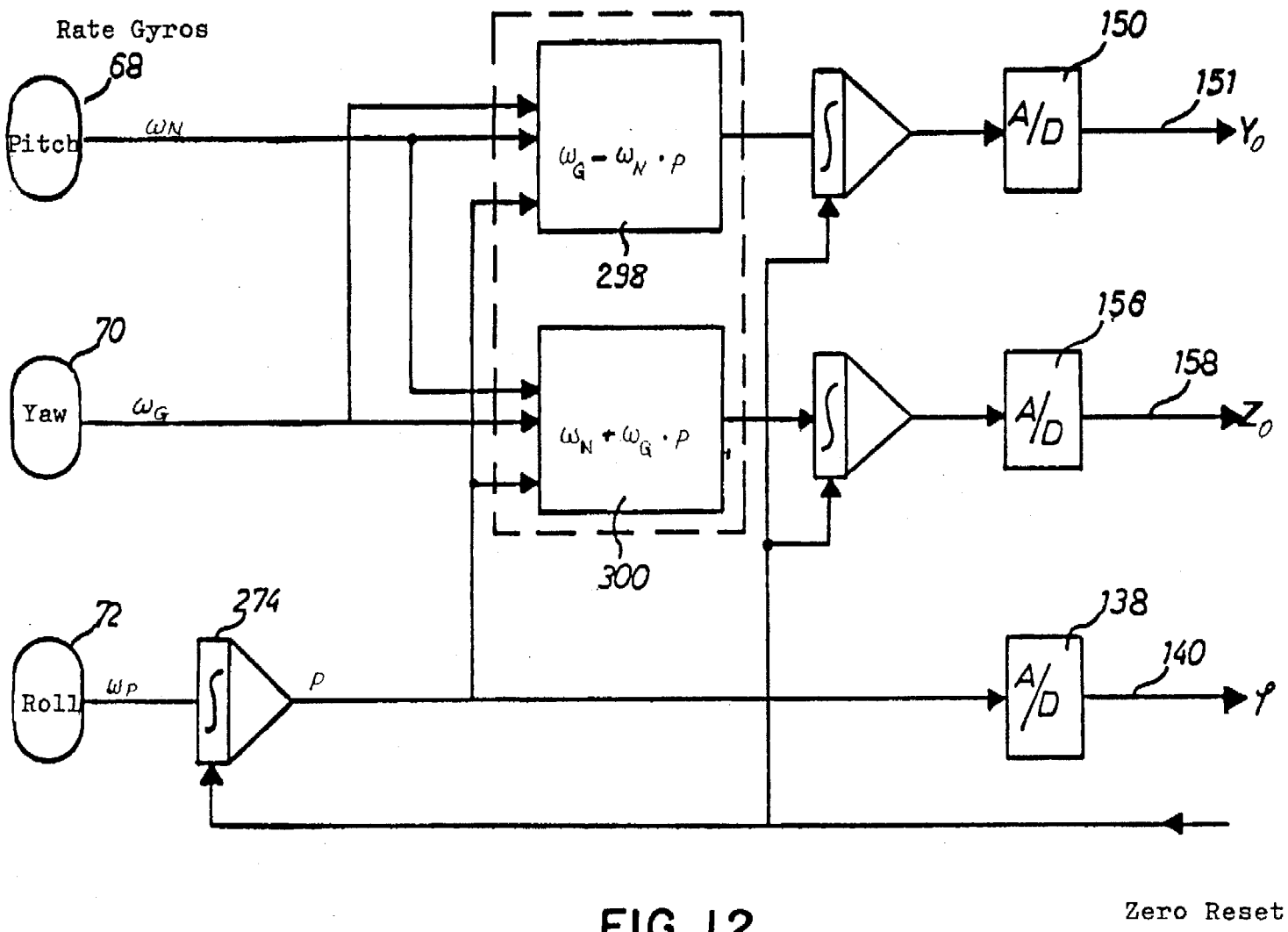

FIG. 12 shows a simplified version of the coordinate transformer and integrator circuit.

In the following it will be assumed that the seeker head of the invention is provided on a missile (rocket) which is used against intruding air targets (aircraft). The seeker head is to detect the air target in its field of view already at rather large distance, to distinguish it from other detected objects, such as banks of clouds or the horizon, and to guide the missile into the target.

Figure 1:
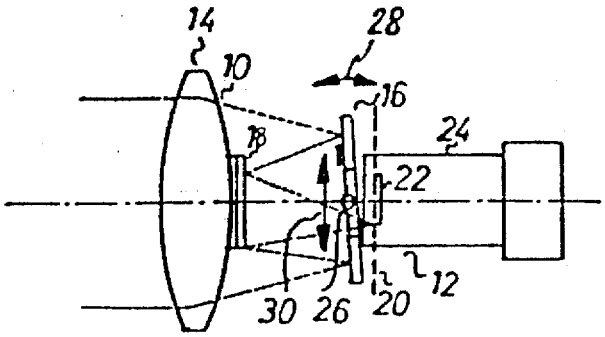
FIG. 1 shows schematically the opto-electronic part of the seeker head.
Figure 2:
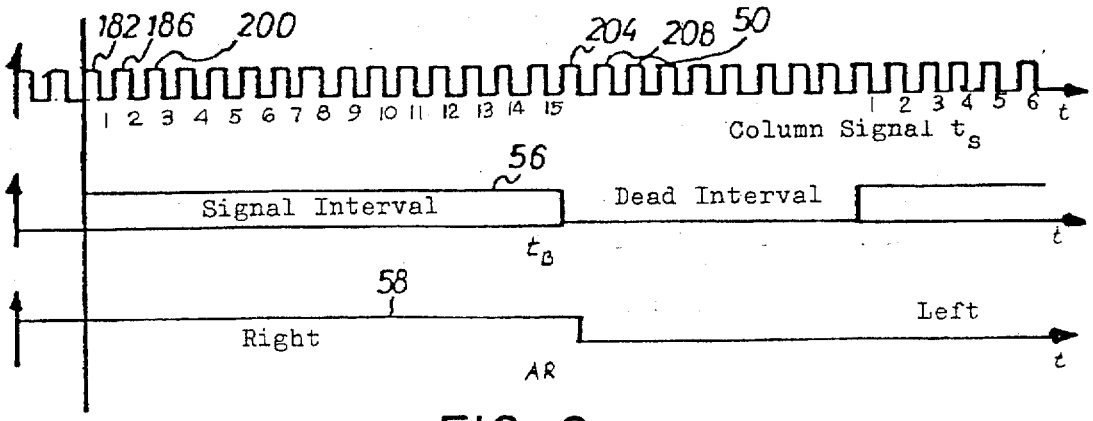
FIG. 2 shows the reference signals generated by the angle encoder on the mirror axis of the seeker.

The optical system 10 of the seeker head comprises a lens 14 and two plane mirrors 16 and 18. Radiation from the object space is focused by lens 14, as indicated in FIG. 1, the path of rays being folded by the two plane mirrors, of which the annular plane mirror 16 is located behind the lens 14 and facing the same, and the plane mirror 18 is affixed centrally to the rear face of the lens 14. Thus the lens 14 forms an image of the field of view as viewed by it in a plane 20. A linear array detector 22 is located in this plane 20. The plane mirror 16 is mounted for tilting movement about an axis 26 and is caused to oscillate about the axis 26 by a drive mechanism, as indicated by the double-arrow 28. Due to these oscillations the image of the visual field is moved back and forth in the plane 20 relative to the linear array detector 22, as indicated by double-arrow 30. The linear array detector 22 consists of a linear array of photoelectric (or infrared sensitive) detectors 32, the linear array of the detectors 32 extending perpendicular to the direction of movement, as indicated by the double-arrow, of the image of the field of view. Rectangle 24 and the rectangle to the right thereof represent a cooling device on which the detector is mounted. This cooling device, which is an old technique and forms no part of the invention, improves the signal to noise ration. An angle encoder (not shown) is provided on the mirror axis 26 and provides the following signals as a function of the mirror movement (FIG. 2)

$t_s$ the inverted column signal, which is applied during the scanning of each column. This signal is supplied also during the dead interval, $t_B$ the picture signal, which during the scan discriminates between the signal interval and the dead interval, and AR the direction-of-scan signal, which characterizes the direction of scan (left-right).

Figure 3:
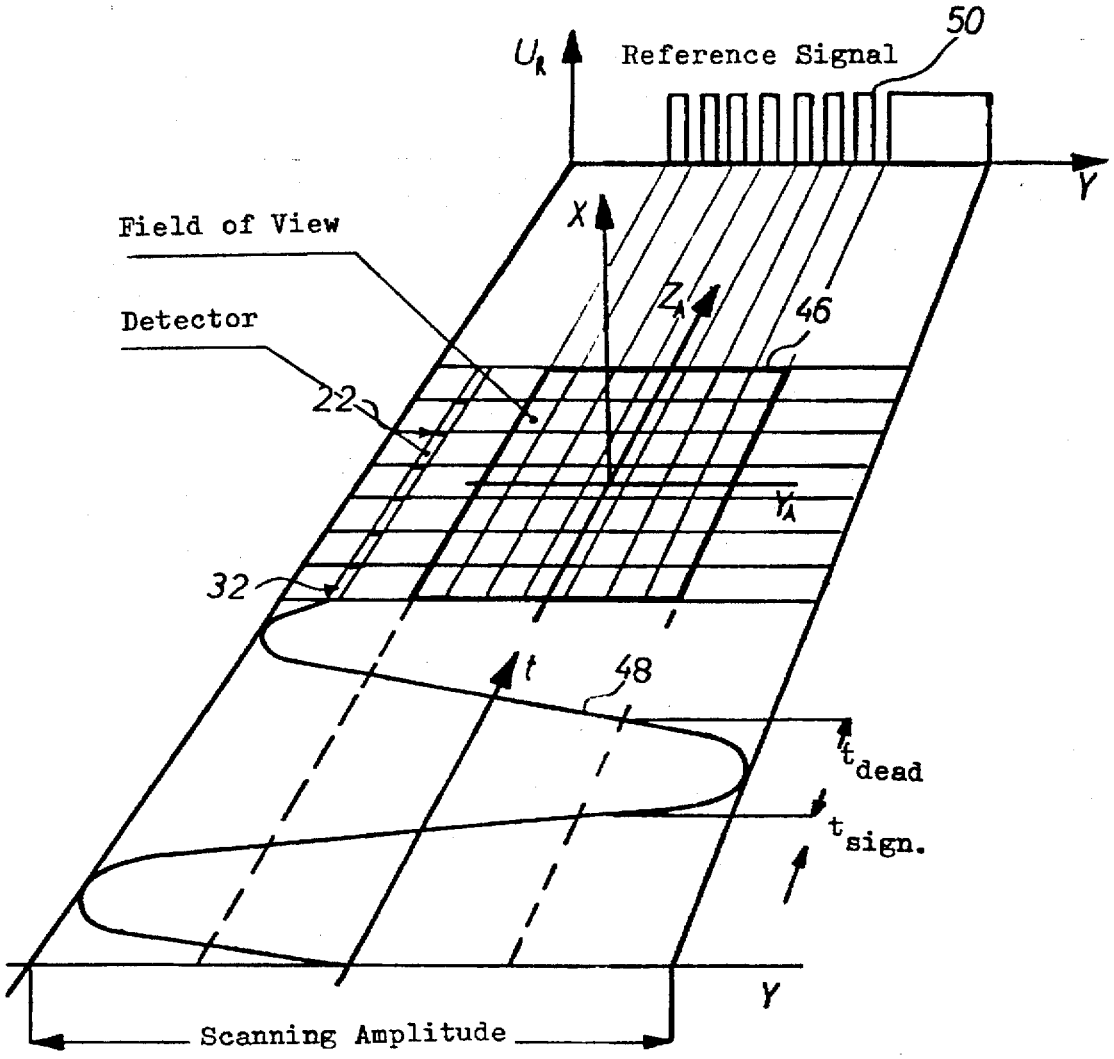
FIG. 3 illustrates schematically the scanning of the field of view with the seeker head.

The scanning of the image of the field of view 46 is schematically illustrated in FIG. 3. In practice the linear array detector 22 is stationary as described and the image of the field of view oscillates due to the oscillating movement of the mirror 16. For the sake of more convenient illustration, however, the image of the field of view 46 has been regarded as stationary and the linear array detector 22 has been regarded as movable in FIG. 3.

The oscillation, which is illustrated by curve 48 in FIG. 3, extends beyond the field of view, whereby the field of view is scanned approximately uniformly. The scanning is effected alternatingly in one or the other direction (direction I and direction II), dead intervals being interposed between the scans. The signal processing takes place during these dead intervals.

The angle encoder generates reference pulses 50 (FIG. 3) by which the individual lines (in direction $Z_A$ in FIG. 3) are marked. The linear array detector 22 comprises fifteen detectors 32, and fifteen reference pulses 50 are generated during each scan, whereby the field of view is subdivided into fifteen times fifteen pixel.

Figure 4:
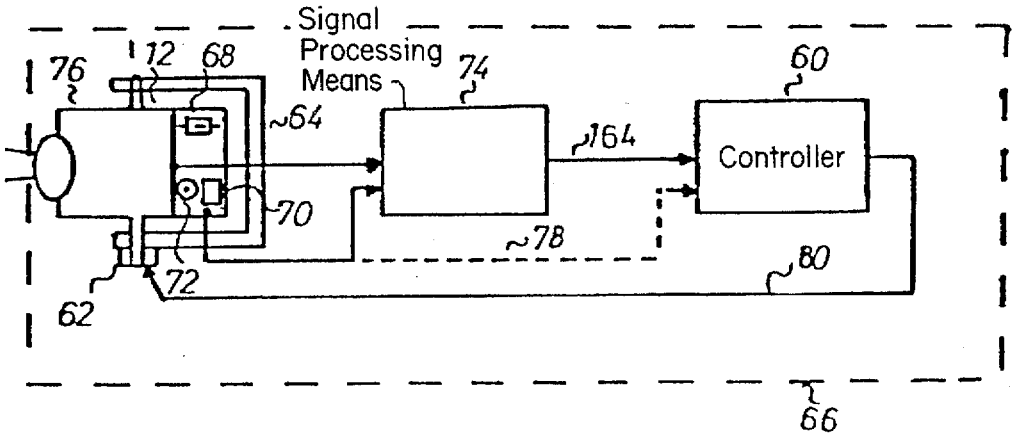
FIG. 4 shows schematically the cooperation of a seeker of the invention with a controller by which the seeker is oriented towards a target.

The seeker 12 is suspended on gimbals, as indicated in FIG. 4, and is adapted to be tilted relative to the gimbal 64 and the seeker head 66 in accordance with controller signal which are provided by a controller 60.

Three rate gyros 68,70 and 72 are mounted on the seeker and respond to the angular speeds $\omega_G$, $\omega_N$ and $\omega_\phi$ of the seeker 12 about the pitch, yaw and roll axes, respectively.

Numeral 74 designates signal processing means to which the picture informations of the opto-electronic system 76 of the seeker 12 and, in addition, the angular speed signals $\omega_G$, $\omega_N$ and $\omega_\phi$ from the rate gyros 68,70,72 are supplied. The signal processing means 74 apply output signals to the controller 60, to which also signals from the rate gyro are applied, as indicated by the dashed line 72. The controller 60, in turn, controls the torquer 62, as illustrated by line 80.

The field of view 46 is scanned cyclicaly. Picture informations from consecutive scans are processed together by the signal processing means. In order to be able to process picture informations from different scans together, these informations have to be referenced to a common inertial coordinate system. A seeker head-fixed coordinate system, as provided by the pixels of the described scanning of the image of the field of view 46 with line addresses and column adresses would not represent such a common inertial coordinate system. A stationary target would be displaced upwards, if the seeker head 66 and thus the seeker 12 made a downward pitch movement. Therefore a picture element might be imaged on a quite different pixel during the second scan of the image of the field of view than during the first scan, so that the seeker head is unable to "know", whether this is the same target or another one, or whether the target moves or the seeker head pitches. For this reason a coordinate correction circuit is provided which transforms the pixels during consecutive scans to a common inertial coordinate system, whereby consecutive picture informations become comparable.

The signal processing means 74 are illustrated in greater detail in FIGS. 5*a* to *g*, these figures showing the different phases of the program, the respective active components being drawn in thick solid lines.

The signal processing means 74 comprise a coordinate transformer and integrator circuit 84 to which the angular speed signals $\omega_N$, $\omega_G$ and $\omega_\phi$ illustrated by an arrow 86 are supplied. This coordinate transformer and integrator circuit 84 provides the translatory and angular variations $Y_o$,$Z_o$ and $\phi_o$ of the seeker head-fixed coordinate system referenced to the momentarily defined inertial coordinate system. These signals $Y_o$,$Z_o$ and $\phi_o$ are available in digital form at an output 88 of the coordinate transformer and integrator circuit 84.

The analog signals from the linear array detector 22, which are represented by an arrow 89, are converted into digital picture informations by means of an analog-to-digital converter circuit 90, i.e. a digital word is associated with each pixel of the image of the field of view 46 in accordance with the signal amplitude generated in this pixel by the radiation intensity. These picture informations with their addresses in the seeker head-fixed coordinate system are available at an output 92 of the analog-to-digital converter circuit 90.

Numeral 94 designates an end value memory which has a data input 96 and a data output 98 and which serves, in a manner still to be described, to memorize the inertial movement $Y_E$,$Z_E$, $\phi_E$ of the seeker head-fixed coordinate system between consecutive scanning times t(n−1) and t(n).

A coordinate transformer circuit 100 serves to transform the addresses of the pixels at the output 92 from the seeker head-fixed coordinate system into the momentarily defined inertial coordinate system.

Two memories 102 and 104 are provided into which, in a manner still to be described, the amplitude values and the addresses of the pixels as transformed by the coordinate transformer circuit 100 are read.

A target selection logic 106 contains signals from the outputs 108 and 110 of the memories 102 and 104, respectively, and recognizes a target in accordance with certain criteria still to be described. The coordinates of this target are stored in a deviation memory 112, which provides a deviation signal representing the target deviation at an output 114.

The program of the signal processing is controlled by a program control unit 116, which receives input signals $t_S$ and $t_B$ (FIG. 2) from the angle encoder of the seeker 12 at inputs 118,120, and an input signal $T_A$ from the target selection logic 106 at an input 122, when the target selection logic 106 has recognized a target. The program control unit 116 provides control commands for the various components, in a manner still to be described, these control commands at the various control inputs having the following meaning:

OE=release of data output (output enable)

IE=release of data input (input enable)

R=reset

MUX=parallel-to-series conversion

AR=scanning of picture to the right (FIG. 3).

The output 92 of the analog-to-digital converter circuit 90 is connected to the input 126 of the coordinate transformer circuit 100 through a bus 124. Furthermore the output 108 of the memory 102 is arranged to be applied to the input 126 through a bus 128, and an output 132 of the target selection logic 106 is arranged to be applied to input 126 through a bus 130. In addition the output 108 of the memory 102 is applied to an input 136 of the target selection logic through a bus 134.

The output 88 of the coordinate transformer and integrator circuit 84 is arranged to be applied to the input of the end value memory 94 through a bus 138 and to an input 142 of the coordinate transformer circuit 100 through a bus 140. In addition the output 98 of the end value memory 94 can be applied to the input 142 of the coordinate transformer circuit 100 through a bus 144.

The output 146 of the coordinate transformer circuit 100 is arranged to be applied to an input 150 of the first memory 102 through a bus 148, to an input 154 of the second memory 104 through a bus 152, and to an input 158 of the deviation memory 112 through a bus 156.

The output 110 of the second memory 104 is connected to an input 162 of the target selection logic 106 through a bus 160.

Eventually the deviation memory 112 supplies a deviation signal to a bus 164 through its output 114.

The program is determined by the flux diagram of FIG. 6.

During the scanning of the field of view (signal interval) the seeker 12 provides a signal $t_B$, as mentioned. Furthermore a square wave signal $t_S$ is generated during the scanning of each column of the field of view by the mirror 16 and the linear array detector 22, said signal returning to zero, while the mirror 16 is moved from a position, in which the linear array detector 22 scans a column of the field of view, into the next position, in which the adjacent column is scanned. The column signal is generated also during the dead interval. A signal interval flipflop FFS (not shown) is provided in the program control unit 116.

In the initial state of FIG. 5*a* prior to the beginning of the n-th picture scan A(n), neither the signal $t_B$ nor the column signal $t_S$ are present. Those coordinate displacements $Y_E$,$Z_E$, $\phi_E$, which were measured in the time interval between the scan A(n−2) at the moment t(n−2) and the scan A(n−1) at the moment t(n−1) are stored in the end value memory 94. The first memory 102 contains the digital amplitude values from the picture scan A(n−1) with their addresses, i.e. the associated coordinates, transformed into an inertial coordinate system, which coincided with the seeker head-fixed coordinate system at the moment t(n−2). The memory 104 contains also the digital amplitude values from the picture scan A(n−1), the addresses, i.e. the associated coordinate values, being referenced by transformation to an inertial coordinate system which coincided with the seeker head-fixed coordinate system at the moment t(n−1), i.e. at the moment when the picture scan A(n−1) was completed.

It be assumed that the target selection logic has not yet recognized a target, so that the signal TA does not appear at the input of the program control unit 116. In this case the program control unit 116 is in the waiting loop W3 in the flux diagram of FIG. 6: The preceding scan did not result in the recognition of a target by the target selection logic 106, so that the flux diagram of FIG. 6 has to be followed from the rhombus 166 "target recognized" downwards. The test "$t_B$=?", which is symbolized by the rhombus 168, is negative, as long as the signal $t_B$ does not yet appear, whereby the waiting loop W3 is run through.

When the signal $t_B$ appears at the beginning of the scan, thus the test according to rhombus 168 is positive, the waiting loop W3 is left, and the flux diagram is to be followed along the line 170 to the rhombus 172 ("$t_S$=?"), which symbolizes a test for whether the signal $t_S$ is present or not. If this is the case, as FIG. 2 shows for the beginning of the signal time, the flux diagram is to be followed to the bottom to the rhombus 174 ("$t_\beta$=?"). which again symbolizes a test for whether the signal $t_\beta$ is present or not.

If this, as assumed, is the case, the path will extend from the rhombus 174 to the left to a rhombus 176, which symbolizes a test for whether the signal interval flipflop has been set. If this is not the case at the beginning of the scan, the flux diagram will be followed downwards to a rectangle 177, which symbolizes the setting of the signal interval flipflop FFS, and to the rectangle 178. Then the analog-to-digital converter 90 is reset by a signal R. Subsequently a test will be made, whether the column signal $t_S$ is present, what is symbolized by the rhombus 180. As long as this signal $t_S$ is present, which corresponds to the first pulse 182 in FIG. 4, the waiting loop W2 will be run through. During this time the signals from the linear array detector 22 are converted into corresponding digital amplitude and address signals (coordinates) by the analog-to-digital converter.

When the signal $t_S$ has ceased, i.e. on the rear end of the pulse 182 (FIG. 2), the flux diagram is to be followed from the rhombus 180 through line 184 and line 170 to the rhombus 172 again. As long as the signal $t_B$ is zero, i.e. in the gap between the pulses 182 and 186 in FIG. 2, the waiting loop $W_1$ wil be run through. This waiting loop W1 is left upon appearance of the next pulse 186 of the signal $t_B$. Then the flux diagram is run through as before downwards via rhombus 174 ("$t_B$=?") to the rhombus 176. As meanwhile the signal interval flipflop FFS has been set in accordance with rectangle 177, the test "FFS set" has a positive result, and the flux diagram is run through from the rhombus 176 to the right to the rectangle 188.

Then the commands MUX and OE are applied by the program control unit to the analog-to-digital converter 90 through lines 190 and 192, and the data from the analog-to-digital converter 90 are read serially into the coordinate transformer circuit 100 through the bus 124. Furthermore the command OE is applied to the coordinate transformer and integrator circuit 84 through line 194. Thereby the coordinate transformer and integrator circuit 84 supplies the signals stored at its output through bus 140 to the coordinate transformer circuit 100. Eventually the first memory receives the command IE through line 196 and takes over the output signals of the coordinate transformer circuit through bus 148.

The coordinate transformer and integrator circuit 84 provides the variations $Y_o$,$Z_o$, $\phi_o$ of the seeker head-fixed coordinate system relative to an inertial coordinate system which, at the moment t(n−1) of the preceding scan, coincided with the seeker head-fixed coordinate system. The coordinate transformer circuit 100 provides the measured digital amplitude values of the respective pixels from the data of the coordinate transformer and integrator circuit 84 and the data of the analog-to-digital converter, the addresses corresponding to the coordinates in the said inertial coordinate system at the moment t(n−1). Thus the addresses have been transformed by the coordinate transformer circuit 100. These data are stored in the memory 102.

After this procedure, the flux diagram is again run through to the rectangle 178, i.e. the analog-to-digital converter 80 is reset by a command R through line 198. Subsequently the waiting loop W2 is run through for the duration of the pulse 186 of the signal $t_S$, and the waiting loop W1 is run through during the gap between the pulse 186 and the next-following pulse 120. When the pulse 200 appears, the same operation is carried out with the next column of the field of view in the same manner. This procedure is repeated column-by-column, until the whole field of view has been scanned. At the end of this scan the digital amplitude values of all pixels are stored in the first memory 102 with the coordinates transformed to the moment t(n−1) as addresses.

Now the signal $t_B$ ceases, i.e. after the rhombus 174 has been reached, the flux diagram is followed to the right, which again symbolizes a test, whether the signal interval flipflop FFS has been set. This is still the case with the next pulse 204 following the rear end of the signal $t_B$. Consequently the flux diagram is run through to the left back to the rectangle 206 and the rectangle 188. In accordance with rectangle 206 the signal interval flipflop FFS is reset. Subsequently the data corresponding to the last column of the field of view are read out and transformed and are stored in the memory 102, wherenpon the analog-to-digital converter 100 is reset.

When the flux diagram is run through the next time through waiting loop W2, waiting loop W1 and rhombus 174 (after the next pulse 208 has appeared) to rhombus 202, the flux diagram is to be followed therefrom further to the right in FIG. 6. This loop represents the signal processing which takes place in the dead interval between the scans of the field of view.

At first the end values $Y_E$,$Z_E$, $\phi_E$ of the coordinate displacement which exist, after the scan of the field of view has been completed, are read in into the end value memory 94 through bus 138. To this end the end value memory 94 gets a command IE from the program control unit 116 through a line 210, while the coordinate transformer and integrator circuit 84 gets the command OE through line 194. This is symbolized by the rectangle 214 in the flux diagram.

Thereafter the integrators in the coordinate transformer and integrator circuit 84 are reset by means of a command R through line 216. Then the coordinate transformer and integrator circuit provides, at its output 88, the further variations of the seeker head-fixed coordinate system relative to that inertial coordinate system which coincided with the seeker head-fixed coordinate system at the moment, when the integrators were reset. This operation is symbolized by the rectangle 218 of the flux diagram.

In the next step, symbolized by the rectangle 220 of the flux diagram, the store contents of the two memories 102 and 104 are applied to the target selection logic 106 through bus 134 and bus 160, respectively (FIG. 5*d*). To this end a command OE is applied to the first memory 102 through line 222, and the target selection logic 106 gets a command IE through line 224 to take over the data from the second memory 104 through bus 160 and to make a target selection.

The memory 102 contains, as described, the data of the scan A(n), the coordinates of the pixels being transformed into an inertial coordinate system which coindided with the seeker head-fixed coordinate system at the moment t(n−1), namely at the moment, at which the integrators of the coordinate transformer and integrator circuit 84 has been reset (rectangle 218). As will be explained hereinbelow, the memory 104 contains the data of the scan A(n−1), the coordinates of the pixels being also transformed into the inertial coordinate system, which coincided with the seeker head-fixed coordinate system at the moment t(n−1). Thus the two memories provide the data resulting from consecutive scans referenced to indentical coordinate systems, whereby the data are comparable with each other.

The target selection logic 106 may, for example, operate in accordance with the method of "m from n selection" for the target recognition. This method is known per se (RCA "Electro-Optics Handbook" (1968) 8-1 to 8-7). With this method the assumption is made that the target signal is only slightly different from the noise of the opto-electric receiving system. Therefore there is a certain probability of a false target signal being supplied from a pixel from a first scan of the field of view, depending on the level of the lowest threshold of the analog-to-digital converter circuit 90 to which the signal from the receiving system is applied. As the noise is uncorrelated, the probability of false target recognition in the target selection logic 106 can be reduced by observing the same pixel in a number n of consecutive scans. If a predetermined number m of exceedings of the lowest threshold is not achieved thereby, the pixel information may be erased in the target selection logic as false target. In the other case a target is recognized. If a plurality of targets is recognized this way, that target is fixed as the one to be tracked, which is closest to the center of the field of view. The target selection logic 106 supplies a signal TA to the input 122 of the program control unit, when a target has been recognized.

After the storage contents of the two memories 102 and 104 have been supplied to the target selection logic. 106, an exchange of the storage contents takes place, which is symbolized by the rectangle 226 in the flux diagram. The storage contents of the memory 104 is overwritten by the storage contents of the memory 102, the addresses of the digital amplitudes corresponding to the individual pixels being, however, transformed into an inertial coordinate system which coincided with the seeker head-fixed coordinate system at the moment t(n), i.e. at the moment of the resetting of the integrators of the coordinate transformer and integrator circuit 84, which is effected after the scan A(n). The transformation parameter $Y_E$,$Z_E$ and $\phi_E$ for this transformation are stored in the end value memory 94, as described (rectangle 214).

As illustrated in FIG. 5*e*, a command OE is applied by the program control unit 116 to the end value memory 94 through line 228. Then the end value memory 94 supplies the transformation parameters $Y_E$,$Z_E$ and $\phi_E$ to the coordinate transformer circuit 100 through bus 144 and input 142. Furthermore the program control unit 116 applies an order OE through the line 222 to the first memory 102 whereby this memoy supplies its storage contents to the input 126 of the coordinate transformer circuit 100 through the bus 128. An order IE, which is applied by the program control unit to the second memory through a line 232 causes take-over of the digital amplitute values from the memory 102 with the addresses transformed by the coordinate transformer circuit 100.

Now the result of the scan A(n) is stored in memory 104 referenced, however, to an inertial coordinate system which coincided with the seeker head-fixed coordinate system at the moment t(n).

The computing operation to be carried out to this end by the coordinate transformer circuit is slightly different from the computing operation for the transformation of the coordinates from the analog-to-digital converter 90 for reading into the memory 102. These computing operations are:

$$Y_{A(n)}=(Y_{K(n-1)}-Y_{E(n)}).\cos\phi_{E(n)}+(Z_{K(n-1)}Z_{E(n)}\sin\phi_{E(n)}$$

$$Z_{A(n)}=(Z_{K(n-1)}Z_{E(n)})\cos\phi_{E(n)}-(Y_{K(n-1)}-Y_{E(n)}\sin\phi_{E(n)}$$

wherein $Y_{A(n)}$,$Z_{A(n)}$ are the coordinates of a picture element in the seeker head-fixed coordinate system at the moment t(n), $Y_{K(n-1)}$,$Z_{K(n-1)}$ are the coordinates of a picture element in the seeker head-fixed coordinate system at the moment t(n−1), $Y_{E(n)}$,$Z_{E(n)}$ are the attitude variation end value signals of the translatory displacement of the coordinate system from the moment t(n−1) till t(n), and $\phi_{E(n)}$ is the end value of the rotation of the seeker head-fixed coordinate system from the moment t(n−1) till t(n).

This change of the transformation equation of the coordinate transformer circuit 100 is caused by a change-over command U which is supplied by the program control unit 116 through a line 234.

In the manner described the result of the scan A(n−1) transformed into an inertial coordinate system associated with the moment t(n−1) had been read into the memory 104 during the preceding cycle.

After the data have thus be supplied to the target selection logic 106 and the data from memory 102 have been exchanged to memory 104, a test is made, as is symbolized by rhombus 166, whether the target selection logic 106 has recognized a target and provides the signal TA. If this is not the case the operation described is repeated through rhombus 168. When a target has been recognized, the flux diagram is run through from the rhombus 166 to the left to the rectangle 236. Thereafter the operations illustrated in FIG. 5*f* will be carried out.

The target selection logic 106 gets a command OE through line 238 and supplies the data of the recognized target, referenced to the coordinate system associated with the moment t(n−1), to the coordinate transformer circuit 100 through bus 128. The end value memory 94 gets a command OE through line 228, and the coordinate transformer circuit gets the change-over command U through line 234 as in FIG. 7*e*. Therefore it transforms the target coordinates into the coordinate system associated with the moment t(n) in accordance with the equation given hereinbefore. The deviation memory 112 gets the command IE through line 240, whereby the transformed target coordinates are read into the deviation memory 112 through bus 156, the deviation memory providing a corresponding target deviation signal at its output 114 and the bus 164.

Subsequently the program control unit is operated in the waiting loop W3, until the signal $t_B$ initiates a new scan of the field of view.

At the beginning of this next scan A(n+1) the system is in the state illustrated in FIG. 5*g*. Memory 102 contains the result of the scan A(n) referenced to the coordinate system, which is associated with the moment t(n−1). This storage contents is overwritten during the scan A(n+1). Memory 104 contains the result of the scan A(n) referenced to the coordinate system which is associated with the moment t(n). The deviation memory 112 contains the target coordinates also referenced to the coordinate system which is associated with the moment t(n) and provides a corresponding deviation signal.

The analog-to-digital converter circuit 90 is illustrated in detail in FIG. 7, only four detectors of the linear array detector 22 being shown. The signals of the detectors are amplified by pre-amplifiers 242. The output signal of each amplifier 242 is filtered by a filter 244 and is applied to a conventional analog-to-digital converter 246. The resolution of the analog-to-digital converter 246 is selected such that the least significant bit (LSB) defines a relatively low threshold, which is matched to the signal amplitude of remote targets, while the most significant bit (MSB) defines a relatively high threshold which is matched to the signal amplitudes of near targets. The outputs of the analog-to-digital converters are connected to a memory 248 each. The memory 248 takes over the analog-to-digital converted amplitude values during the scanning of a pixel, the memory 248 itself being so designed that during the scanning always the maximum aplitude value remains stored. At the end of the scan, the memories 248 are read out by a multiplexer 250 on the command MUX through line 190, and thereafter the memories are reset by the reset command R for the scanning of the next pixel.

The output signals of the multiplexer 250 are composed of data (i.e. digital amplitude values) and addresses of the scanned pixels. A line address results from the respective detector of the linear array detector 22. A column address is provided by a column counter 253, to which the reference pulses of the column signal (FIG. 4) $t_S$ are supplied. A direction signal AR causes upward or dounward counting of these reference pulses depending on the direction of scan.

On output gate 254, which is arranged to be opened by the OE-command through line 192, controlls the application of the data and addresses to the bus 124.

The coordinate transformer circuit 100 receives the attitude variation signals $Y_o$,$Z_o$, $\phi_o$ and thereby changes the addresses of the individual picture elements defined by the line and column numbers $Y_A$,$Z_A$ in the seeker head-fixed coordinate system in accordance with $$Y_K=Y_A \cos \phi_o-Z_A \sin \phi_o+Y_o$$

$$Z_K=Z_A \cos \phi_o+Y_A \sin \phi_o+Z_o,$$

wherein

- $Y_K$,$Z_K$ are the coordinates of a picture element in an inertial coordinate system,
- $Y_A$,$Z_A$ are the coordinates of the picture element in the seeker head-fixed coordinate system of the image of the field of view 46,
- $Y_o$, $Z_o$ are, as attitude variation signals, the translatory displacements of the seeker head-fixed coordinate system in inertial space, and
- $\phi_o$ is the rotation of the seeker head-fixed coordinate system.

These conditions can be seen from FIG. 8, in which T is a target and $Y_{AT}$,$Z_{AT}$ designate the target coordinates in the seeker head-fixed coordinate system and $Y_T$*,$Z_T$* designate the target coordinates in a coordinate system rotated relative to the seeker head-fixed coordinate system through the angle −$\phi$.

An example of the coordinate transformer circuit 100 is illustrated in FIGS. 9 and 10. It transforms the addresses of the individual pixels with each scan of the field of view and reads the amplitude values into the memory 102 under the transformed addresses. If, for example, a pixel with the seeker head-fixed coordinates $Y_A$,$Z_A$ is applied, the amplitude data from the respective pixel are read into that storage location the address of which corresponds to the transformed coordinates.

FIG. 9 illustrates the coordinate transformer circuit 100 schematically. The value from the coordinate transformer and integrator circuit 84 is applied to a computer 258 through bus 140 and the values $Y_A$ and $Z_A$ from the analog-to-digital converter circuit 90 are applied to the computer through bus 124. $Y_A$ and $Z_A$ are practically the addresses of a pixel in a seeker head-fixed coordinate system, i.e. the number of a detector element of the linear array detector and a column number provided by the angle encoder. The computer forms $$Y_y \cos \phi-Z_A \sin \phi.$$

The output signal of the computer together with $Y_o$, which is provided by the coordinate transformer and integrator circuit 84, is applied to an adder 260, which provides $Y_K$ on the bus 148. In similar manner $\phi, Z_A$ and $Y_A$ are supplied to a computer 264, which forms $$Y_A \sin \phi + Z_A \cos \phi.$$

This output of the computer 264 together with $Z_o$, which is also applied through bus 140, is applied to an adder 266. The adder provides $Z_K$ also on the bus 148.

The set-up of the computer 264 and adder 266 is illustrated in greater detail in FIG. 10. The computer 264 contains a read-only memory (ROM) 268 and a read-only memory 270. $Y_A$ and are supplied to the read-only memory 268 as address. The read-only memory 268 provides $Y_y \sin \phi$. $Z_A$ and also $\phi$ are supplied to the read-only memory 270 as address. Then the read-only memory 178 provides $Z_A \cos \phi$. The two numerical values provided by the read-only memories 268 and 270 are applied to an adder 272, which forms therefrom $Y_A \sin \phi + Z_A \cos \phi$. The output of the adder 272 together with the representation of $Z_o$ limited to the two most significant bits are applied to the adder 266, which provides $Z_K$.

The computer 258 is constructed in similar manner.

FIG. 11 illustrates one embodiment of an analog circuit arrangement for forming the attitude deviation signals $Y_o, Z_o$.

The roll gyro 72 provides as output signal the angular speed $\omega_\phi$ of the seeker head about the roll axis. This angular speed $\omega_\phi$ is integrated by means of an integrator 274. The integrator is reset to zero by a signal R on line 216 after each scan of the field of view. Therefore it povides the angle $\phi$ through which the seeker head 12 has rotated about its roll axis since the last scan of the image of the field of view 42. This angle $\phi$ is digitalized by an analog-to-digital converter 276 and is available at an output 278, which is part of the data output 88. The output signal of the integrator 274 is applied to a sine function generator 280 and to a cosine function generator 282, which provide signals representing $\sin \phi$ and $\cos \phi$, respectively. The signals $\sin \phi$ and $\cos \phi$ as well as signals analog to the angular speeds $\omega_G$ and $\omega_N$ about yaw and pitch axes from the yaw and pitch gyro 70 and 68, respectively, are applied to an analog computer circuit 284. The computer circuit 146 forms $$Y_o = \omega_G \cos \phi - \omega_N \sin \phi$$

This signal is integrated by means of an integrator 286, which is also arranged to be reset to zero by the signal R on line 216. The output signal of the integrator 148 is then analog to the transversal displacement $Y_o$ of the coordinate system. This analog output signal is converted into a corresponding digital word at an output 289 by an analog-to-digital converter 288.

In similar manner the signals $\sin_\phi$ and $\cos_\phi$ as well as the signals $\omega_G$ and $\omega_N$ are applied to a computer circuit 290. The computer circuit 152 forms $$Z_o = \omega_N \cos \phi + \omega_G \sin \phi.$$

The output signal of the computer circuit 290 is integrated by means of an integrator, 292, which is also arranged to be reset to zero by the signal on line 216. Then the output signal of the integrator 292 is analog to the transversal displacement $Z_o$ of the coordinate system. This analog output signal is converted into a corresponding digital word at an output 296 by an analog-to-digital converter 294.

The outputs 278,289 and 296 form the data output 88 of FIG. 5*a*.

Thus the circuit of FIG. 11 provides the three attitude deviation signals $Y_o, Z_o$ and $\phi$ in digital form.

A simplified circuit is shown in FIG. 12. It is assumed therein that the angle is small so that $\cos\phi = 1$ and the sine can be replaced by the angle. Corresponding elements are designated by the same reference numerals in FIG. 12 as in FIG. 11. Then the sine and cosine function generators can be omitted, and the computer circuits 298 and 300, respectively, receive directly the output signal $\phi$ of the integrator 274. The computer circuit 298 forms $$Y_o = \omega_G - \omega_N \phi$$

and the computer circuit 300 forms $$Z_o = \omega_N + \omega_G \phi.$$

We claim:

1. A system comprising:

(a) a carrier, (b) a seeker head movably mounted on the carrier to "look" towards a target, (c) field of view scanning means associated with the seeker head for periodically scanning a field of view observed by the seeker head, (d) a gyro assembly associated with the seeker head, (e) image storing means for storing the results of scans, and (f) a coordinate transformer circuit receiving signals generated by the gyro assembly and controlled thereby to reference and compare the images of two consecutive scans to a common coordinate system.

2. The system as set forth in claim 1, characterized in that the gyro assembly comprises rate gyros, from the signals of which the attitude variation signals are generated by means of a coordinate transformer and integrator circuit, the integrators of the coordinate transformer and integrator circuit being arranged to be reset to zero once during each scan.

3. The system as set forth in claim 1, characterized in that the gyro assembly comprises pitch, yaw and roll gyros which respond to angular speeds about the pitch, yaw and roll axes, respectively, that the output signal of the roll gyro is applied to a first integrator the output signal of which is converted by a first analog-to-digital converter into a digital attitude variation signal representing the roll movement of the seeker head, that the analog output signal of the first integrator is applied to a sine function generator and to a cosine function generator, that the output signals of the sine function generator, of the cosine function generator, of the pitch and of the yaw gyros are applied to a first computing circuit which forms therefrom an output signal $$\omega_G \cos \phi - \omega_N \sin \phi,$$

wherein $\omega_G$ is the output signal of the yaw gyro $\omega_N$ is the output signal of the pitch gyro, and $\cos \phi$ and $\sin \phi$ are the output signals from the cosine and sine function generators, respectively, that the output signal from the first computer circuit is applied to a second integrator the output signal of which is converted by a second analog-to-digital converter into a digital attitude deviation signal representing the translatory movement of the seeker head-fixed coordinate system in a first inertial direction, that the output signals of the sine function generator, of the cosine function generator, of the pitch and of the gaw gyros are applied to a second computer circuit which forms therefrom $$\omega_N \cos \phi + \omega_G \sin \phi,$$

and that the output signal of the second computer circuit is applied to a third integrator, the output signal of which is converted by a third analog-to-digital converter into a digital attitude deviation signal which represents the tranlatory movement of the seeker head-fixed coordinate system in a second direction perpendicular to the first inertial direction.

4. The system as set forth in claim 1, characterized in that the gyro assembly comprises pitch, yaw and roll gyros which respond to the angular speeds about the pitch, yaw and roll axes, respectively, that the output signal of the roll gyro is applied to a first integrator the output signal of which is converted by a first analog-to-digital converter into a digital attitude deviation signal representing the roll movement of the seeker head that the analog output signal of the first integrator and the output signals of the pitch and of the yaw gyros are applied to a first computer circuit, which forms an output signal $$\omega_G - \omega_N \phi,$$

wherein $\omega_G$ is the output signal of the yaw gyro, $\omega_N$ is the output signal of the pitch gyro, and $\phi$ is the output signal of the first integrator, that the output signal of the first computer circuit is applied to a second integrator the output signal of which is converted by a second analog-to-digital converter into a digital attitude deviation signal representing the translatory movement of the seeker head-fixed coordinate system in a first inertial direction, that the analog output signal of the first integrator and the output signals of the pitch and yaw gyros are applied to a second computer circuit, which forms an output signal $$\omega_N + \omega_G \cdot \phi$$

and that the output signal of the second computer circuit is applied to a third integrator the output signal of which is converted by a third analog-to-digital converter into a digital attitude deviation signal representing the translatory movement of the seeker-head fixed coordinate system in a second direction perpendicular to the first inertial direction.

5. The system as set forth in claim 3 or 4, characterized in that the coordinate transformer circuit (100) comprises a first digital computer (258) to which the output signal ($\phi$) of the first analog-to-digital converter and coordinates ($Y_A$,$Z_A$) of a picture element in the seeker head-fixed coordinate system are applied, and which forms $$Y_A \cos \phi - Z_A \sin \phi,$$

wherein $Y_A$ and $Z_A$ are the coordinates of the picture elements in the seeker head-fixed coordinate system and $\phi$ is the output signal of the first analog-to-digital converter, that, furthermore, the coordinate transformer circuit (100) comprises a first adder (260) to which the digital output signal of the first computer and the output signal ($Y_o$) of the second analog-to-digital converter are supplied and which provides a corrected coordinate ($Y_K$) in an inertial coordinate system, that the coordinate transformer circuit (100) comprises a second digital computer (264) to which the output signal ($\phi$) of the first analog-to-digital converter and the coordinates ($Y_A$,$Z_A$) of the picture element in the seeker head-fixed coordinate system are applied, and which forms $$Y_A \sin\phi + Z_A \cos \phi,$$

and that, eventually, the coordinate transformer circuit (100) comprises a second adder (266) to which the digital output signal of the second computer (264) and the output signal ($Z_o$) of the third analog-to-digital converter are applied and which provides the other corrected coordinate ($Z_K$) in the inertial coordinate system.

6. The system as set forth in claim 5, characterized in that each of the computers (258,264) comprises a pair of read-only memories (268,270), each of which has applied thereto as address a respective one of the coordinates ($Y_A$ and $Z_A$) in the seeker head-fixed coordinate system, each in combination with the output signal ($\phi$) of the first analog-to-digital converter, the read-only memories having stored under each address $Y_A \cos \phi$ and $-Z_A \sin \phi$ or $Y_A \sin \phi$ and $Z_A \cos \phi$, respectively, and that the outputs of the read-only memories (268,270) are appied to an adder (272).

7. The system as set forth in anyone of the claim 1, characterized in that, during each signal processing cycle in a first operation during a scan, the picture informations are transformed by the coordinate transformation circuit into an inertial coordinate system which after completion of the preceding scan, coincided with the seeker head-fixed coordinate system, and the picture informations thus transformed with respect to their addresses are written into a first memory, that upon completion of each scan the attitude variation signals from the coordinate transformation and integrator circuit (84) are written into an end value memory (94), that in a second operation the picture informations stored in the first memory (102) are transformed by the coordinate transformer circuit (100), with the end values of the attitude variation signals stored in the end value memory (94), into an inertial coordinate system which, at the end of the scan, coincided with the seeker head-fixed coordinate system, and the picture informations thus transformed with respect to their addresses are written into a second memory (104), and that a target selection logic (106) is provided, to which the data from the first and second memories (102 and 104, respectively) are applied.

8. The system as set forth in claim 7, characterized in that, by a signal (TA) provided by the target selection logic (106) upon the target data provided by the target selection logic (106) are transformed by the coordinate transformation circuit (100) with the end values ($Y_E$, $Z_E$, $\phi_E$) of the attitude variation signals provided by the end value memory, into an inertial coordinate system which coincided with the seeker head-fixed coordinate system at the end of the last scan, and that the target data thus transformed are written into a deviation memory, which applies deviation signals to the controller (60).

* * * * *